United States Patent [19]

Radish

[11] 4,404,873

[45] Sep. 20, 1983

[54] BLADE SHARPENER

[75] Inventor: Madeline L. Radish, Westerville, Ohio

[73] Assignee: Howard Ray Longbrake, Grafton, Ohio

[21] Appl. No.: 310,507

[22] Filed: Oct. 13, 1981

[51] Int. Cl.[3] ..... B24B 3/54; B25B 1/22

[52] U.S. Cl. ..... 76/82; 269/3; 51/221 BS

[58] Field of Search ..... 76/82.2, 82, 88; 269/3, 269/1, 2, 87, 87.1, 87.2, 87.3, 900; 51/217 R, 218 R, 221 BS, 224

[56] References Cited

U.S. PATENT DOCUMENTS

| | | | |
|---|---|---|---|
| 1,152,321 | 8/1915 | Kimball | 76/82 |
| 1,464,442 | 8/1923 | Palser | 76/82.2 |
| 1,819,170 | 6/1974 | Longbrake | 269/3 |
| 1,832,968 | 11/1931 | DeArmey | 76/82.2 |
| 2,528,943 | 11/1950 | Calabrese | 76/82.2 |
| 2,557,093 | 6/1951 | Garbarino | 76/82.2 |
| 4,320,892 | 3/1982 | Longbrake | 269/3 |

FOREIGN PATENT DOCUMENTS 204125 of 0000 Australia .

*Primary Examiner*—Roscoe V. Parker
*Attorney, Agent, or Firm*—Gustalo Nunez

[57] ABSTRACT

In a Blade Sharpener having a vise to hold a blade, an elongated sharpener reciprocally movable across the edge of the blade, and a guide on the vise to guide the sharpener, the provision of a clamp and bracket to removably support the vise on a stationary support in a preselected position in preselected attitude relative to the balde and sharpener.

8 Claims, 8 Drawing Figures

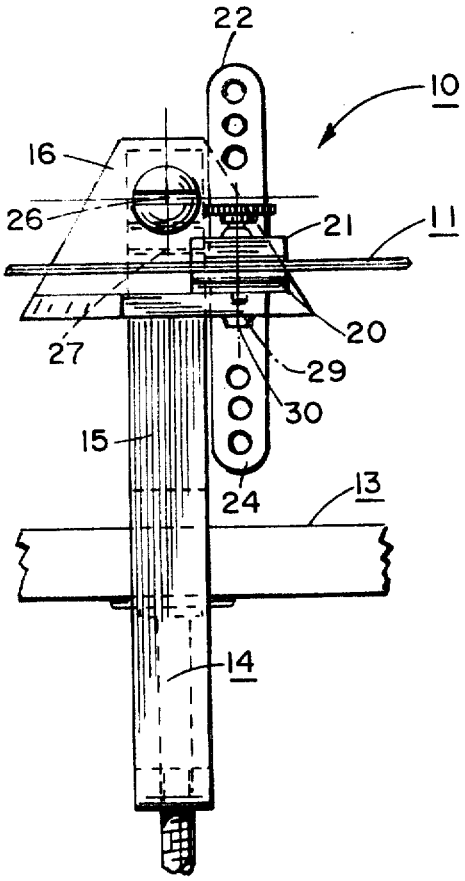
FIG. 5
FIG. 6
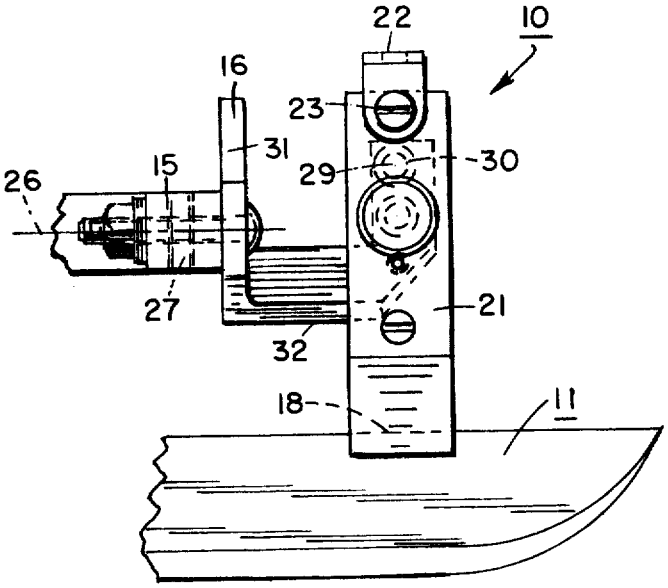
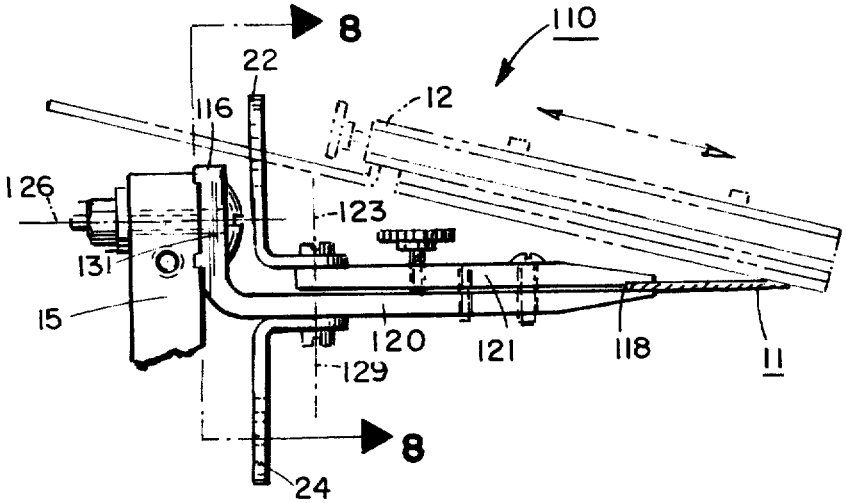
FIG. 7
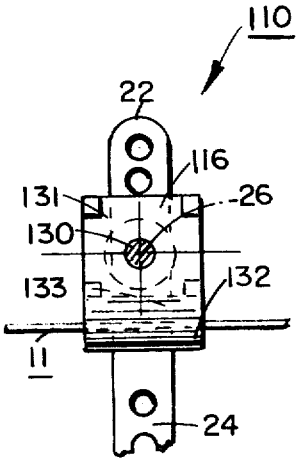
FIG. 8

BLADE SHARPENER

BACKGROUND OF THE INVENTION

1. Field to Which Invention Relates

This invention relates to the combination of a support clamp, a vise adapted to pinch a blade having a cutting edge to be sharpened an elongated sharpener engageable with the cutting edge, and a guide on the vise and guiding the sharpener. The clamp is provided with a post extending outwardly therefrom in a direction parallel to and spaced from the guide. A bracket pivotally mounts the vise on the post in such manner that the sharpener may be positioned for receiprocal movement to sharpen the edge. The bracket is pivotally mounted on the post with the mounting pivot axis generally transverse to the pivot axis of the guide.

2. Description of the Prior Art

Prior to the present invention, there have been combinations of vises, clamps, and elongated sharpeners. Of these, the one most similar to the present invention is illustrated in Australia Pat. No. 204,125 which shows a clamp having a post with means for gripping a blade to be sharpened and a sharpener reciprocally carried by a guide on the clamp for movement across the edge of the blade being sharpened. In U.S. Pat. No. 3,819,170 issued to Howard Ray Longbrake for Portable Sharpener, there is illustrated a hand held device for gripping a blade having an edge to be sharpened and for guiding the sharpener during sharpening of the blade. Also U.S. Pat. No. 1,832,968 to D. De Armey shows a combination clamp and vise for supporting a pair of shears, but does not show any means for holding and guiding the sharpener during sharpening of the shears.

Statement of the Invention

The present invention is directed to a combination of a support clamp, a vise adapted to pinch a blade having a cutting edge to be sharpened, an elongated sharpener engageable with the cutting edge for longitudinal reciprocal movement there across, and a guide pivoted on the vise and holding the sharpener in its path of reciprocal movement.

One of the objects of the invention is to provide a blade sharpener which may be clamped to a support or table or post while it is being used, or in the alternative, held in an operators hand a further object of the invention is to provide structure for reasonably and adjustably positioning a blade to be sharpened and a reciprocable sharpening tool at a preselected position and attitude relative to a stationary support.

Another object of the present invention, is to provide post and bracket means interconnecting a vise and a supporting clamp so that the vise may be positioned in various positions relative to the clamp.

Another object of the present invention, is to provide for use of a vise to hold a blade to be sharpened and a reciprocally movable sharpener held by a guide on the vise, either as a hand tool or as a bench or table mounted during sharpening of the edge of a blade held in the vise.

Further objects and advantages may be observed from the following description of the invention in conjunction with the several drawings.

FIGURES OF THE DRAWINGS

FIG. 5 is a front view along lines 5—5 of FIG. 1.

FIG. 6 is a top view of the sharpener similar to FIG. 2 with the vise pivoted 90° around the guide axis.

FIG. 7 is a side view of a modification of the knife sharpener; and

FIG. 8 is a view of the knife sharpener taken along lines 8—8 of FIG. 7.

DESCRIPTION

Figure 1:
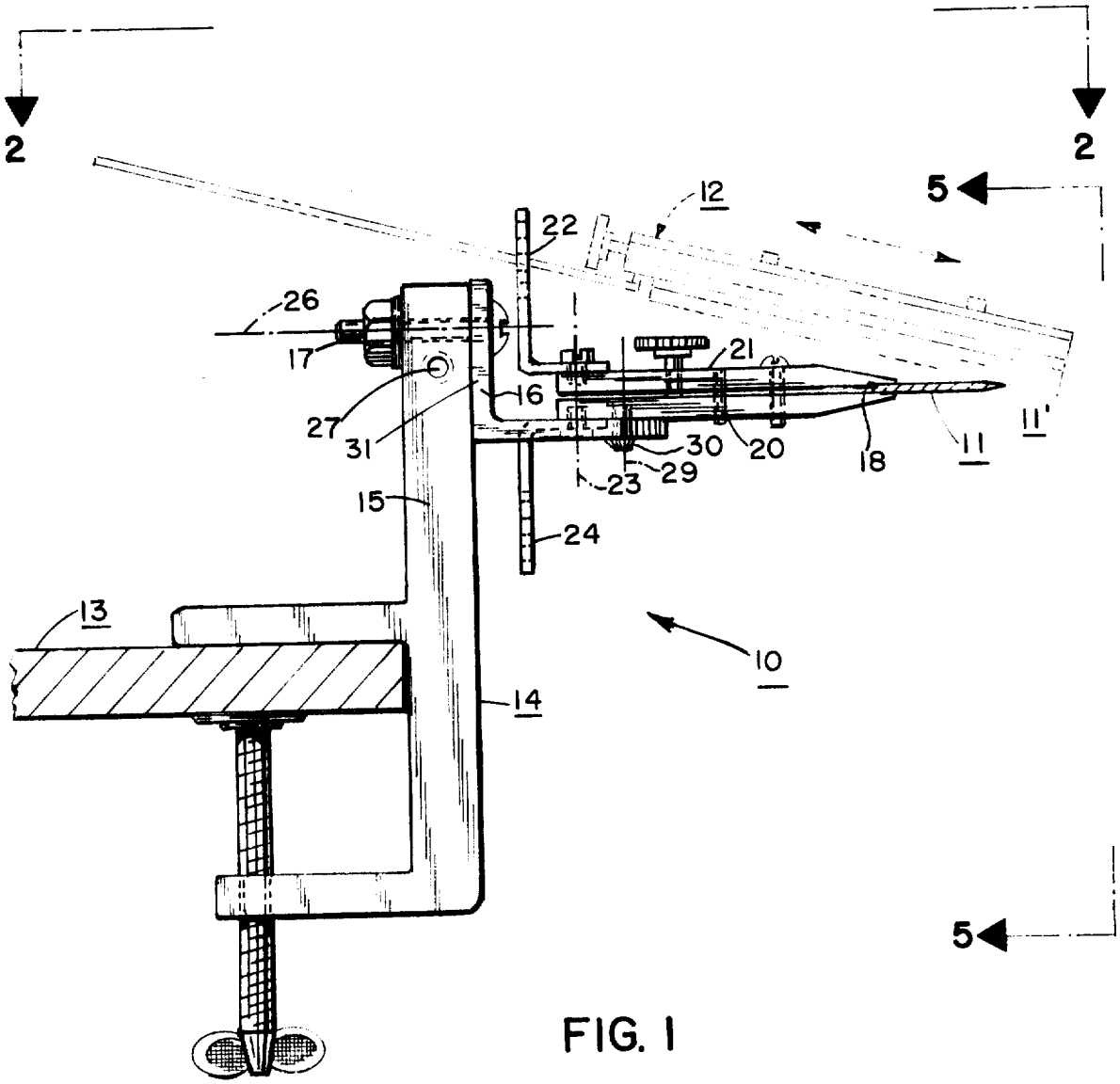
FIG. 1 is a side view of the blade sharpener.
Figure 2:
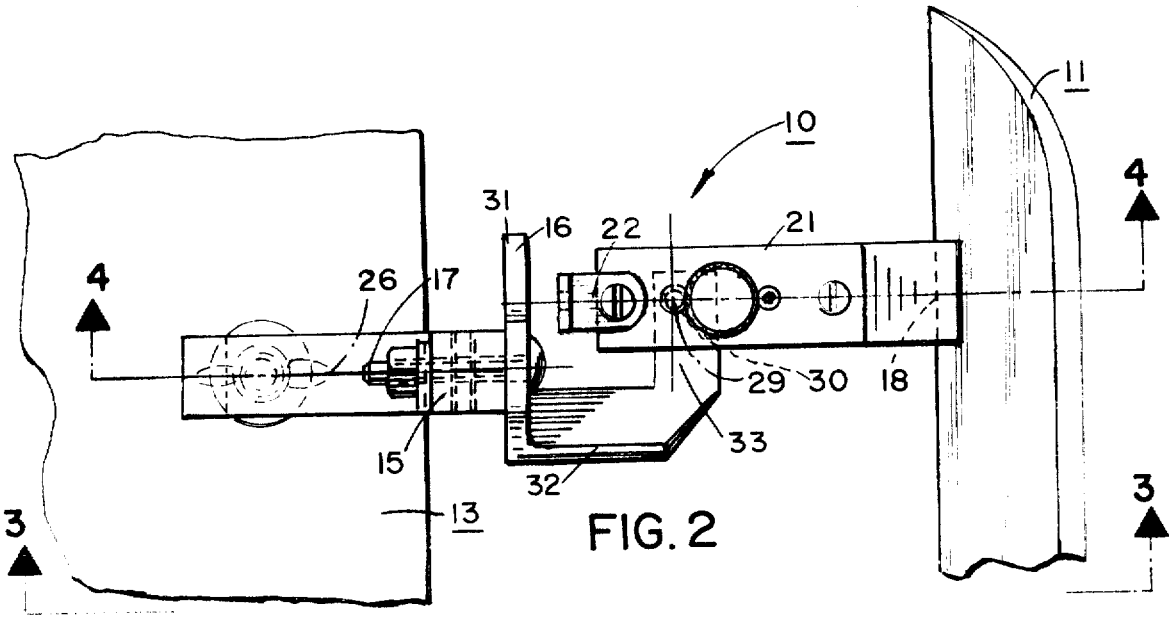
FIG. 2 is a top view of the blade sharpener of FIG. 1.
Figure 3:
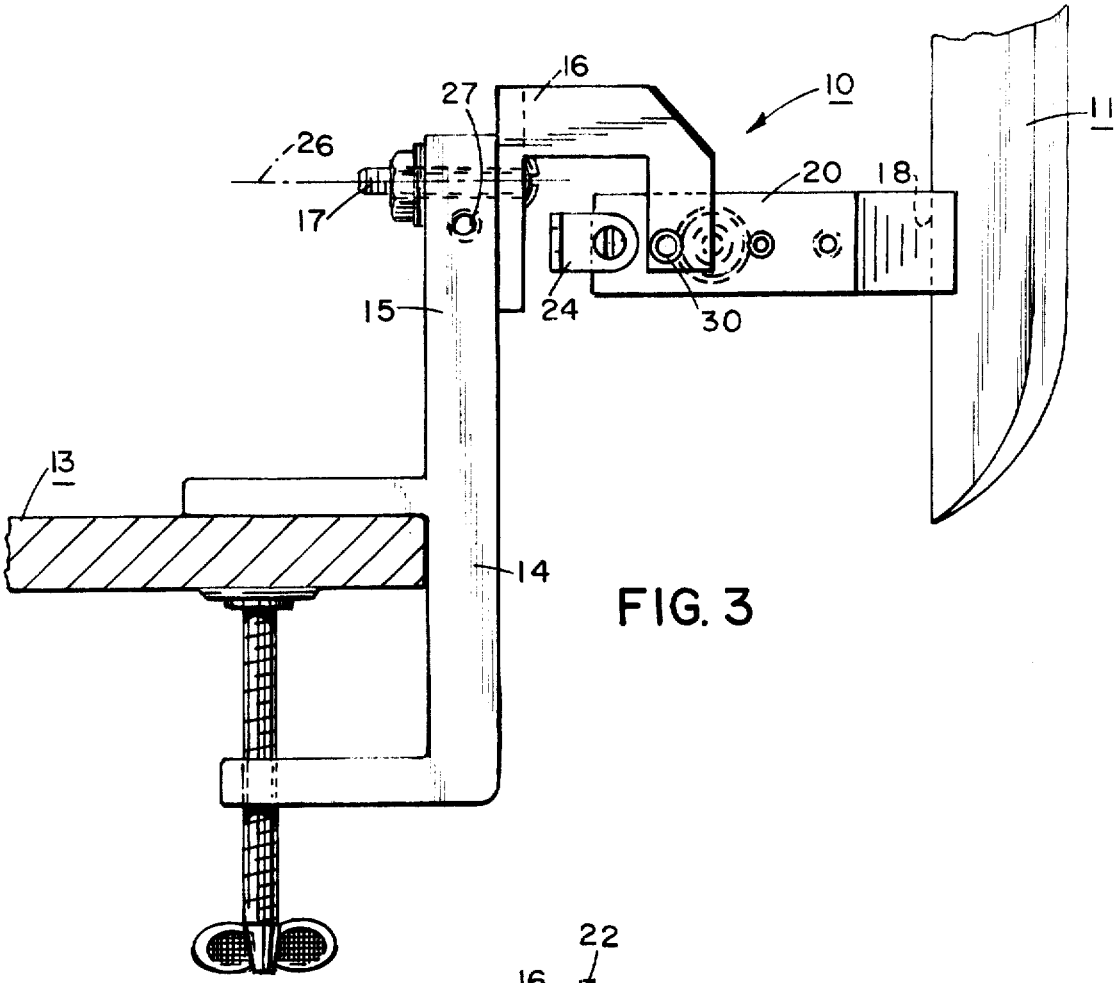
FIG. 3 is a side view of the blade sharpener of FIG. 1, but with the vise mounted in a different position.
Figure 4:
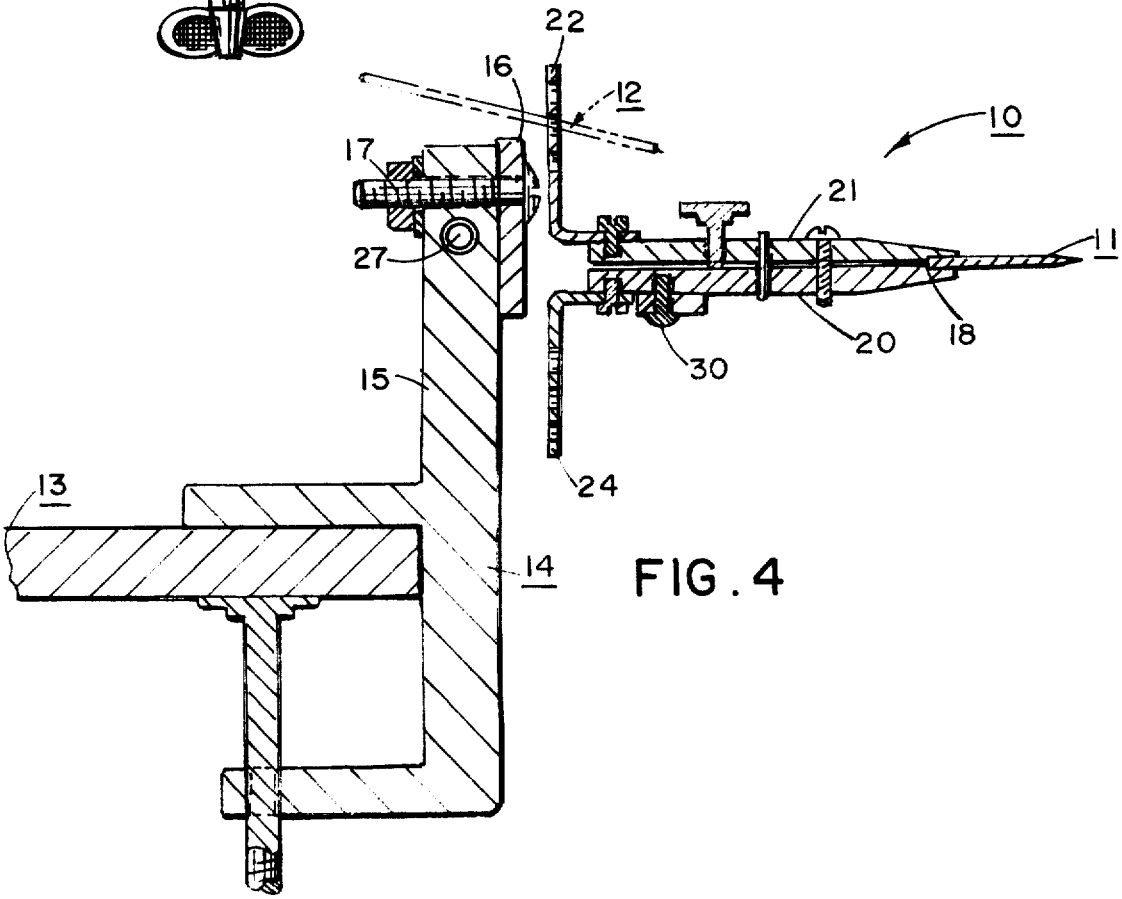
FIG. 4 is a sectional view generally along line 4—4 of FIG. 2.

In the preferred embodiment of the invention as illustrated in FIG. 1, a vise 10 supports a blade 11 for sharpening by an elongated sharpener 12. The vise 10 may be mounted on a stationary support 13 by a support clamp 14 having a post 15. The vise 10 is pivotally and detachably mounted on the post 15 by a bracket 16 and a bolt or the like 17.

In further detail, the vise 10 is constructed from continguous opposing pincer members 20 and 21 moveable towards and away from each other at end 18 and adapted to pinch the blade 11 at blade end 18 thereof and therebetween. The pincer member 20 and the bracket 16 may be formed, each from a single piece of material fashioned in such manner that the bracket 16 extends at an angle to the main portion of the pincer member 20 and is at the end thereof opposite blade and 18. Mounted on pincer member 21 at a distance remote from the blade end 18 or blade and between the blade 11 and the bracket 16 is a guide 22. Guide 22 is pivoted to pincer member 21 for pivotal movement relative thereto and about a guide axis 23. Similarly, a guide 24 maybe pivotally mounted on pincer member 20 for movement about the same guide axis 23. In FIG. 1, the elongated sharpener 12 is illustrated as being guided by the guide 22 during its reciprocal longitudinal movement generally transverse to and across the edge of the blade 11 being sharpened. The sharpener 12 may be removed from the guide 22 and inserted in guide 24 for reciprocal movement and engagement with the other or reverse side of the blade 11.

The post 15 extends outwardly from the clamp 14 in a direction parallel to and in this instance also in a guide plane which would contain the guide axis 23. Also the bracket 16 is pivotally mounted by the bolt 17 for pivotal movement about a support axis 26. Support axis 26 is transverse to the longitudinal direction of the post 15, is also generally transverse to the guide axis 23.

The support axis 26, is generally perpendicular to the edge of a blade 11 being sharpened. The edge 11 is in a plane perpendicular to the guide axis 23 and parallel to support axis 26. The path of reciprocal movement of elongated sharpener 12 and the guide axis 23 lie in or close to a common plane generally transverse to the edge plane of the edge 11 and containing clamp 14 and post 15. It is understood the relationship of the herein described planes and axes are meant to include limited operative movements, positions and dimensions of the posts for the purposes intended.

As illustrated in FIG. 1, the stationary support 13 will hold a blade edge 11, stationary while the elongated sharpener 12 is reciprocally guided by guide 22 in longitudinal reciprocal movement thereacross. When one side of the edge 11 has been sharpened, the sharpener 12 may be removed, the bolt 17 loosened, and the entire vise 10 pivoted about pivot axis 26 to position guide 24 where guide 22 is illustrated in FIG. 1. The sharpener 12 may then be inserted in guide 24 for further sharpening of edge 11'. It is noted that in pivoting the vise 10 about axis 26, the blade 11 and the edge 11' thereof, is somewhat rotated in a plane transverse to the support axis 26 and parallel to the plane in which the guide axis 23 is rotated, and parallel to the direction in which the post 15 extends.

It is further noted that the guides 22 and 24 are disposed generally between the post 15 and the blade 11 or blade end 18, and that the distance between the blade being sharpened and the post 15 is less than the length of the path of longitudinal movement of the elongated sharpener 12. The line or path of longitudinal movement of the sharpener 12, thus extends past the end of, or across, or along side of, but spaced from the post 15.

The post 15 may also be provided with means, for example hole 27 to receive the bolt 17 in a second direction through the post so that bracket 16 may be mounted on either of two sides of the post. Bolt 17 may be in the form of any type of securement member, including camming arrangements, screws and the like, which will provide securement of the bracket 16 to the post 15 for pivotal movement relative thereto, and also for removal of the vise 10 from the post 15 so that it may be held in a hand while an operator sharpens the edge of the blade 11.

The post and bracket removably secure the blade and sharpener in a preselected and adjustable position and attitude relative to a stationary support for easy longitudinal movement of the sharpener across the edge of a blade held in the vise. If desired the bracket may be detached from the post on the clamp so that the vise, and the guide carried thereby may be hand held while sharpening the edge of the blade. In either position or in any attitude, the sharpener 12 is moved in the path of movement as established by blade edge 11 in conjunction with guide 22 (or 24) and vise 10.

In FIGS. 1 through 6, bracket 16 is a separate piece of material. Bracket 16 is pivotally and removeably mounted on the post 15 for pivotal movement about support axis 26. The bracket 16 pivotally supports the vise 10 by being pivotally secured to the pincer member 20 in a pivot axis 29. The pivot axis 29 may easily be provided by using a screw 30 or the like to secure bracket 16 and pincer member 20 together in such manner that the vise 10 may be removed from the bracket if desired. Pivot axis 29 is parallel to the guide axis 23 and is located between the guide axis 23 and a blade 11 being sharpened.

Bracket 16 comprises three portions including, a post portion 31, center portion 32, and a vise portion 33. Center portion 32 and vise portion 33 lie in a common plane but transverse to each other so as to provide a flat "L" shaped arrangement, with vise portion 33 extending from one end of the center portion 32 and the post portion 31 extending from the other end of the center portion 32. The post portion 31 lies in a plane transverse to the center portion 32. As is best illustrated in FIG. 6, the vise 10 may be pivoted relative to the bracket 16 and about the pivot axis 29. Also the vise 10 and the bracket 16 may be pivoted about the pivot axis 26 and relative to the post 15. The center portion 32 thus provides an open space between the post portion 31 and the vise portion 33 for permitting freedom of movement of the guides 22 and 24, between the post and the blade. In FIGS. 7 and 8 there is illustrated a modification of my invention wherein the pincer 120 of vise 110 and bracket 116 are formed from a single piece of material fashioned in such manner that bracket 116 extends at an angle to the main portion of pincer member 120 and is at the end thereof opposite blade end 118. In this modification support axis 126 is transverse to the longitudinal direction of post 15, is also generally transverse to the guide axis 123 and is in the guide plane containing both axes in FIG. 7.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention as hereinafter claimed.

What is claimed is:

1. In the combination of a support clamp, a vise adapted to pinch a blade having a cutting edge to be sharpened, an elongated sharpener engageable with said cutting edge for longitudinal reciprocal movement thereacross, and a guide pivoted on the vise on a guide axis and holding the sharpener in its path of reciprocal movement, the provision of, a post extending outwardly from said clamp in a direction parallel to a guide plane containing the guide axis, bracket means pivotally supporting said vise on said post on a support pivot axis generally transverse to the direction of the post, and positioning said vise and said guide and said sharpener with the sharpener extending generally across the post and next adjacent to and spaced from said post.

2. The combination as defined in claim 1, including said vise pinching said blade with the cutting edge positioned whereby said cutting edge may be rotated in an edge plane transverse to the support pivot axis and parallel to the guide plane.

3. The invention as defined in claim 1, including a separate guide on each of the opposite sides of the vise with both guides having a common pivot axis and with the bracket pivotally supporting said vise in such manner that both sides of a cutting edge of a blade pinched in the vise may be sharpened with the elongated longitudinal movement of the sharpener being on the same side of the post.

4. The invention as defined in claim 1, including said vise having two pincer members moveable towards and away from each other to pinch the blade, said bracket and one of said pincer members being integrally joined with each other as a single piece of material.

5. In the combination of a clamp and a vise adapted to pinch a blade having a cutting edge to be sharpened and an elongated sharpener engageable with said cutting edge, the provision of guide means extending outwardly from opposite sides of said vise and guiding said sharpener in longitudinal reciprocal movement transverse to and on the preselected of either side of the cutting edge, a post extending outwardly from said clamp in a direction generally parallel to and spaced from said guide means, a bracket pivotally mounted on said post and pivotally supporting said vise in such manner that said sharpener may be positioned for reciprocal movement on the preselected side of said post.

6. The structure of claim 5 wherein the axis of pivotal mounting of the bracket on the post and the axis of pivotal supporting of the vise on the bracket are in directions generally transverse to each other.

7. The structure of claim 15, wherein said guide means is mounted for rotation about a guide axis disposed parallel to the axis of mounting of the vise on the bracket, said guide means permitting movement of said sharpener along a longitudinal reciprocal line of movement through said guide axis and in a plane including said cutting edge, said plane intersecting said axis of mounting said bracket on said post and said axis of mounting said vise on said bracket.

8. The structure of claim 5 including said sharpener being of such length that the path of its longitudinal reciprocal travel is of length greater than the distance between said edge and said post, and said bracket and vise are alongside said path and between said edge and said post.

* * * * *